United States Patent [19]

Miller

[11] 4,407,103

[45] Oct. 4, 1983

[54] MOBILE UNIT SUPPORT

[76] Inventor: Robert R. Miller, 1425 Clifford St., Ridgecrest, Calif. 93555

[21] Appl. No.: 375,389

[22] Filed: May 6, 1982

[51] Int. Cl.[3] ..... E02D 27/00

[52] U.S. Cl. ..... 52/292; 52/23

[58] Field of Search ..... 52/23, 292, 648, 167, 52/126.7, 126.5; 105/216, 217; 410/77, 80, 81; 280/766

*Primary Examiner*—John E. Murtagh
*Assistant Examiner*—Kathryn Ford
*Attorney, Agent, or Firm*—Lloyd E. K. Pohl

[57] ABSTRACT

A device for preventing a mobilehome from falling to the ground during an earthquake or the like, comprising two flat bases, legs attached to the bases and extending upward therefrom, a spacer attached to the legs to hold them a predetermined distance apart, a frame support assembly attachable to the mobilehome frames resting on the tops of the legs and entrapping them, means attached to the frame support assembly adapted to provide cantilever support and means preventing the frame support assembly from separating from the legs during violent shaking such as that caused by strong earthquakes.

8 Claims, 7 Drawing Figures

MOBILE UNIT SUPPORT

SUMMARY OF THE INVENTION

This invention is a device for protecting mobile home units and the like from falling to the ground and being damaged during an earthquake or the like. The device comprises flat bases which rest on the ground, legs attached to each of the bases, a spacer to keep the legs a predetermined distance apart, a frame support assembly which fastens to the mobile home unit frame, means for attaching the frame support assembly to the spacer to keep the device from shaking apart during an earthquake or the like, and means for supplying cantilever support.

BACKGROUND OF THE INVENTION

1. Field of the Invention

This invention relates to a device for providing support for a mobile home or the like and rendering it more safe in the event of an earthquake, high wind, or the like.

2. Description of the Prior Art

Mobile homes, in some cases, are placed on cement foundations. This renders them nearly as safe as a house on a foundation would be in the event that a large earthquake should occur. However, in many instances, the only support that a mobile home has is a plurality of leveling jacks. Leveling jacks are not attached to the bottom of the mobile home in any way, and, in the event of a large earthquake or the like, the mobile home may be shaken off of them and fall to the ground. Thus, a need exists for some device that can be fastened to the underside of a mobile home and which will provide support in the event that the leveling jacks are shaken from under the mobile home.

Since various mobile home models vary insofar as their under-construction is concerned, it is difficult or impossible to provide a universal support device that can be used under all of them. Mobile homes vary in that sewer pipes, water pipes, electrical wiring and the like are placed in different areas under different models. Mobile homes vary in that different types of cross support are provided in different models.

If support is to be provided, the support should prevent the mobile home from falling if it moves lengthwise or sidewise in the event of an earthquake or the like. Further, the supporting device should be one that is easily adaptable to fit various models. Thus, the foregoing are objects of this invention.

BRIEF DESCRIPTION OF THE SEVERAL FIGURES OF THE DRAWING

DESCRIPTION OF THE PREFERRED EMBODIMENTS

Insofar as is known to the inventor, all mobile homes and manufactured with framework that consists of I beams running the length of the mobile home. Most have perpendicular frame support in the form of a Z wherein the upper leg of the Z is attached to the mobile home and provides support for the mobile home floor. For purposes of this disclosure, these Z-shaped perpendicular support devices will be called ribs.

The purpose of this invention is to provide a device that can be affixed to the aforementioned I beams in a manner whereby the I beams are trapped and cannot escape during violent earthquake shaking or the like. The device is supported by legs extending downwardly to the ground to protect the mobile home from ground impact damage in the event that an earthquake, wind or the like should jar the mobile home from its leveling jacks or other vulnerable support. The device of this invention may be readily understood from the drawings.

Figures 1, 2, 3:
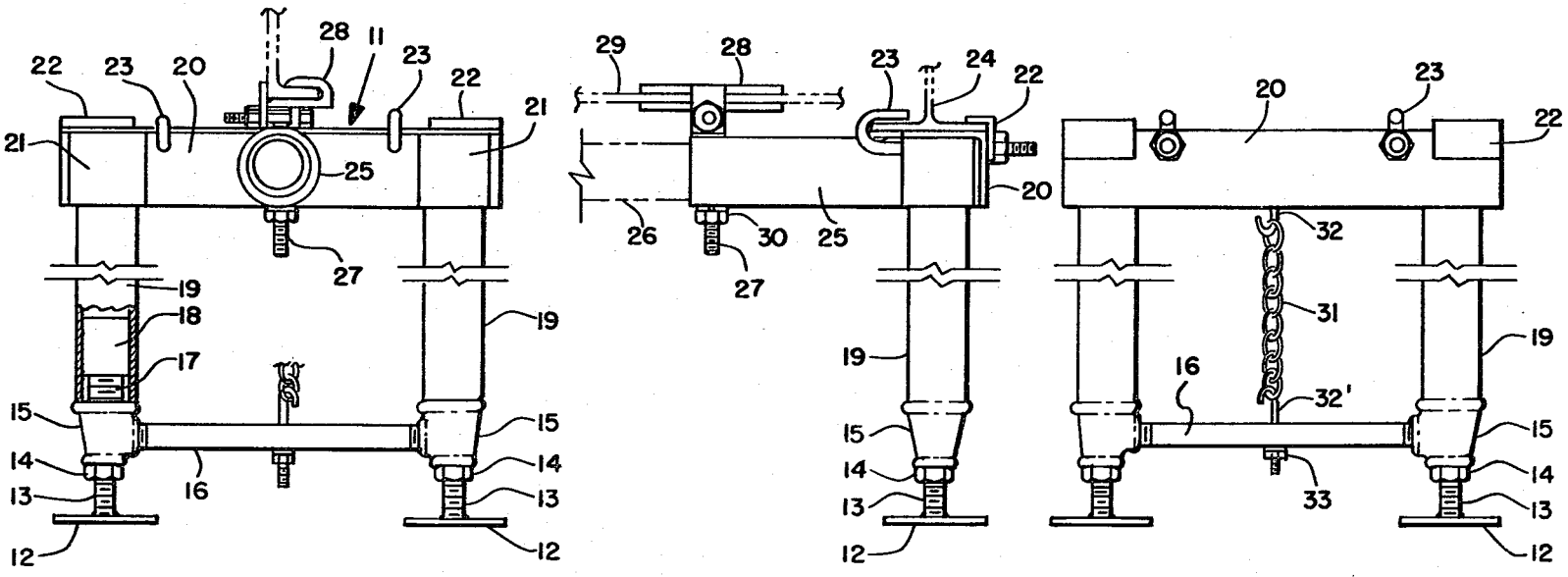
FIG. 1 depicts one view of the device, according to this invention, partially in perspective and partially in cross-section.
FIG. 2 depicts a side view of the device of FIG. 1.
FIG. 3 depicts another view of the device of FIG. 1.

FIG. 1 of the drawing is a partially perspective and partially cross-section view of a device according to this invention. The device 11 has flat bases 12 which are preferably flat steel plates. Attached to each base 12 is a bolt 13. The bolts, as can be seen from the drawing, are attached in a manner whereby they extend perpendicularly upwards from the bases. They are preferably attached by welding although other means of attachment could be used.

The bolts 13, screw into nuts 14 which are spot welded to a pipe tee 15 in a manner whereby the bolts may extend through one opening in the tee for adjustment purposes. The distance of a base from the tee may, of course, be adjusted because of the bolt in the same manner that short legs under a refrigerator can be adjusted. This provides some leveling adaptability.

The legs of the pipe tees 15 are attached to each other by means of a spacer 16 which is, in the preferred mode of practicing this invention, a threaded pipe screwed into the tees at both of its ends.

As can be seen from the drawing, two openings in each tee extend upwardly and downwardly perpendicular to the ground and the third opening extends to the side so that it can be attached to the spacer. Into the upwardly extending opening of each tee 15 is inserted a nipple 17. The nipple is affixed to the tee by means of threads. A coupling 18 is attached to each nipple by means of threads. A pipe 19 fits snugly over each coupling and extends upward.

What may, for convenience, be referred to as a leg of this invention consists of (1) an aforementioned bolt, (2) an aforementioned tee, (3) an aforementioned nut spot-welded to the tee, (4) an aforementioned nipple, (5) an aforementioned coupling, and (6) an aforementioned pipe. Sitting on top of the legs is a frame support assembly. This assembly is made up of a first L-shaped angle iron 20, having two short pieces of pipe 21 affixed to it, preferably by welding, in positions where they fit snugly over the pipes 19 of the legs. When the device is in use, the first L-shaped angle iron fits under and provides support for the base of an I beam that runs lengthwise the length of a mobile home. Other angle irons 22 and J bolts 23 are used to affix the frame support assembly to the mobile home. Their use becomes apparent from FIG. 2. Another pipe 25 is affixed to the first angle iron. Its use will become more apparent from the description of other figures of the drawing.

FIG. 2 is a side view of the device of FIG. 1. FIG. 2 shows the I beam 24 of a mobile home entrapped between angle iron 22 and angle iron 20 and held in place by J bolt 23. Thus, from FIG. 2, the use of angle irons 22 and J bolts 23 becomes apparent. They are used to affix the frame support assembly firmly to the mobile home I beams.

FIG. 2 also makes clear two means for supplying cantilever support for the device of this invention.

One means for doing so is to use pipe 25 which may, for convenience, be called a cantilever support pipe, another pipe 26 and another device 11 like the one depicted affixed to another I beam running the length of the opposite side of the mobile home. When two such devices are affixed to the lengthwise running I beams across from one another and a pipe 26 is inserted into the cantilever support pipes, it becomes impossible for pipe 26 to escape and the pipe 26 supplies cantilever support.

In some instances, it is not possible to use a pipe 26 to supply cantilever support. For example, sewer pipes, water pipes and the like extend lengthwise under the mobile home in certain areas and a pipe 26 cannot be extended widthwise across the home from device to device in these areas. Therefore, it becomes necessary to provide cantilever support in some other manner.

One can omit the pipe 26 of FIG. 2 and provide cantilever support by means of a bolt 27 and a U-shaped rib attachment assembly 28 that is adapted to entrap what the inventor has called a rib (the Z-shaped perpendicular support under a mobile home that is described above). Bolt 27 extends through holes in cantilever support arm 25 in a manner such that it is perpendicular to the ground and is held in place by a nut 30. Attached to the upper end of bolt 27 is the U-shaped rib attachment assembly. The U-shaped rib attachment assembly fits snugly over the bottom leg 29 of the Z-shaped rib and holds it in place providing cantilever support as depicted in FIG. 2.

Since pipes 19 merely fit over coupling 18 and inside of short pipes 21, means for keeping the device from coming apart must be provided. This means is depicted in FIG. 3 which is a view of the rear of the device of FIGS. 1 and 2. A hook 32 is attached to the frame support assembly or, more particularly, to the bottom of the cantilever support pipe. One end of a short piece of chain 31 is hooked over the hook 32. The other end of the short piece of chain 31 is attached to the end of a J bolt 32' which extends through the spacer 16 and which is held firmly in place by a nut 33.

Figure 4:
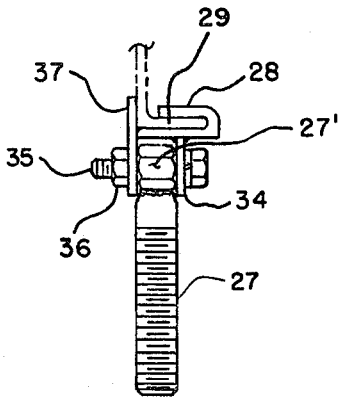
FIG. 4 depicts a side view of a portion of the device of FIG. 1 that is used in providing cantilever support according to one embodiment.

FIG. 4 is a more detailed perspective view of items 27 and 28 which are used to supply cantilever support. Item 27 is simply a bolt that extends through the cantilever support arm and is held in place by a nut. As can be seen from FIG. 4, the U-shaped rib attachment assembly 28 is attached to bolt 27 by means of a plate 34 welded to it, a bolt 35 which extends through an opening in the bolt 27 and a nut 36. The opening in bolt 27 through which bolt 36 passes may simply be a nut 27' welded to the end of bolt 27 as shown in the drawing. This nut has an opening through it which is larger in diameter than is bolt 35 thus permitting one to rotate the U-shaped rib attachment assembly to any desired angle. A washer 37 is utilized in a manner whereby the bottom leg 29 of the Z-shaped rib is entrapped in the U of the rib attachment assembly once the leg of the rib has been inserted.

Figure 5:
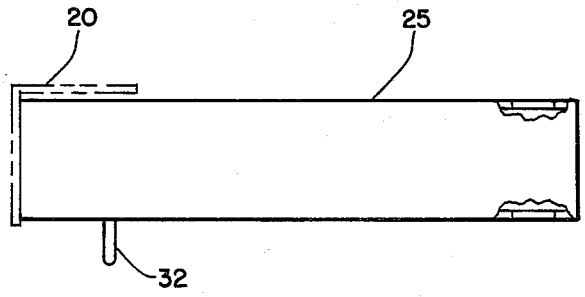
FIG. 5 depicts a portion of the device of FIG. 1.

FIG. 5 depicts a side view of the cantilever support pipe 25 and shows in detail how it is attached to angle iron 20. Hook 32 over which chain 31 of FIG. 3 is hooked is shown extending from the bottom of cantilever support pipe 25 and a portion of the extended end of the cantilever support pipe is cut away to show the relationship of the openings through which bolt 27 passes through the cantilever support pipe.

Figure 6:
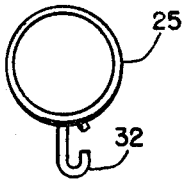
FIG. 6 depicts a portion of the device shown in FIG. 5 from another angle.

FIG. 6 depicts an end view of cantilever support pipe 25 and shows hook 32 attached to it from a different angle than that shown in FIG. 5.

Figure 7:
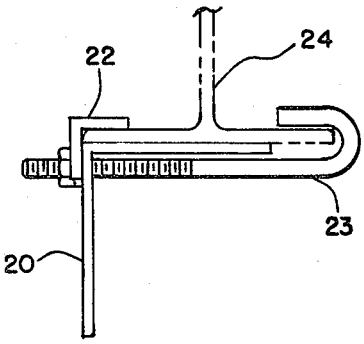
FIG. 7 is a detailed view of a portion of the device of FIG. 1 as one would see it from the side.

FIG. 7 shows a side view of the major frame supporting angle iron 20 with a smaller angle iron 22 attached in a manner whereby the I beam 24 of the mobile home will be entrapped between the two. A J bolt 23 is shown extending through the angle iron 20 and FIG. 7 makes it clear how the smaller angle iron 22 and J bolt 23 are used in conjunction to firmly hold the I beam in place.

The great advantage of this invention is its adaptability. The entire device can be readily manufactured by welding and screwing together readily available off-the-shelf items. The device may be made to fit under any mobile home, no matter what the distances from the ground to the base of the lengthwise running I beams are simply by cutting pipes 19 to the desired length.

As has been explained above, cantilever support may be provided either by extending a pipe between two devices or by actually fastening a device to a mobile home rib or other frame support.

For a typical single-wide mobile home, it is preferred that six of the devices described herein be utilized in the prevention of earthquake damage. Two of the devices are affixed to the lengthwise running I beams opposite one another near each end of the mobile home, and two are attached across from one another near the middle of the mobile home. If possible, pipes extending from one device to the one across from it are used to provide cantilever support. If this is not possible, each of the oppositely located devices is attached to mobile home ribs or other manufacturer provided support to provide cantilever support.

In some mobile homes, no "ribs" are provided. Those mobile homes usually have I beams running lengthwise and angle irons welded to the I beams in a manner whereby the angle irons extend across the width of the mobile home from I-beam to I-beam. The device of this invention may be adapted to fit under such mobile homes and provide cantilever support by simply attaching a pipe to the remote end of the cantilever support pipe by a bolt or the like, running the pipe lengthwise along the bottom of the mobile home to angle irons on either side of it and attaching the pipe to the angle irons.

It will be or should be apparent to those skilled in the mechanical arts that the device of this invention might be useful in ways other than in the provision of support for a mobile home. For example, devices according to this invention could be used to provide support for platforms, decking, wooden structures or almost anything that needs to be supported above the ground with very little adaptation. It can be utilized in almost any situation where structural integrity and portability are required.

I claim:

1. A structural support device for a framework of a structure comprising:

A. two flat bases;

B. legs attached to and extending perpendicularly upward from each flat base;

C. a spacer attached to each of said legs near the bases of the legs for holding said legs a predetermined distance apart;

D. a frame support assembly adapted to entrap each of said legs and to fasten to the framework of the structure to be supported;

E. means attaching said frame support assembly to said spacer in a manner whereby separation of the legs from their frame support assembly is made impossible; and F. means attached to said frame support assembly adapted to provide cantilever support.

2. A device according to claim 1 wherein each of said legs comprises:

A. a threaded bolt attached to said base and extending perpendicularly upward therefrom;

B. a pipe tee having first, second, and third openings attached to said bolt by means of a nut spotwelded over one opening, said tee being attached in a manner whereby the second opening extends perpendicularly to the ground and said third opening is made available for attachment to said spacer;

C. a nipple attached to the second opening in said tee by means of threads and extending upwardly therefrom;

D. a coupling attached to said nipple by means of threads; and

E. a pipe adapted to fit snugly around said coupling.

3. A device according to claim 2 wherein said spacer is a pipe attached to each of said tees by threads.

4. A device according to claim 3, wherein said frame support assembly comprises:

A. a first L-shaped angle iron;

B. two pipes attached to said angle iron in a manner whereby when the angle iron is placed under a structure to support the framework of the structure, the pipes extend downwardly and fit snugly over the leg pipes;

C. two smaller angle irons affixed to said first angle iron in a manner whereby they are adapted to hook over the framework of the structure and entrap the framework between themselves and said first angle iron;

D. at least one J bolt attached to said first angle iron in an adjustable manner whereby the hook of the J may be hooked over framework of the structure to assist in holding the framework in snug contact with said first angle iron;

E. a cantilever support pipe having one end welded to said angle iron in a manner whereby its other end extends away from said angle iron parallel to the ground when the frame support assembly is attached to the structure's framework;

F. a hook attached to said cantilever support pipe in a manner whereby a chain link may be attached to it; and G. means for connecting the end of said cantilever support pipe to the structure to be supported or to a similar structural support device to provide cantilever support.

5. A device according to claim 4 wherein the means of attaching said frame support assembly to said spacer is a chain hooked over the hook attached to said cantilever support pipe and over the hook end of a J bolt extending through said spacer.

6. A device according to claim 5 wherein the means for providing cantilever support comprises a spanner pipe inserted into the end of the cantilever support pipe and into a like cantilever support pipe extending from a like assembly attached to the opposite side of the structure being supported.

7. A device according to claim 6 wherein the means for providing for cantilever support comprises:

A. a bolt that extends through openings in said cantilever support pipe in a manner whereby the bolt is held perpendicular to the ground and which is held firmly in place by nuts above and below said cantilever support pipe; and B. a U-shaped rib attachment assembly attached to the upper end of said bolt and adapted to fit over a mobile home rib and entrap it within the inside of the U.

8. A device according to claim 7 wherein said rib attachment assembly is attached to said bolt in a manner whereby it can be adjusted to fit over a mobile home rib whether the base of the rib is parallel to the ground or at some other angle.

* * * * *